United States Patent [19]

Jackson

[11] Patent Number: 4,983,356

[45] Date of Patent: Jan. 8, 1991

[54] RUTHENIUM BEARING IRON BASE HIGH TEMPERATURE STRUCTURAL ALLOYS

[75] Inventor: Melvin R. Jackson, Schenectady, N.Y.

[73] Assignee: General Electric Company, Schenectady, N.Y.

[21] Appl. No.: 386,744

[22] Filed: Jul. 31, 1989

Related U.S. Application Data

[63] Continuation of Ser. No. 208,905, Jun. 20, 1988, abandoned.

[51] Int. Cl.[5] ..... C22C 38/06

[52] U.S. Cl. ..... 420/35; 420/62; 420/583

[58] Field of Search ..... 420/35, 40, 62, 583

[56] References Cited

U.S. PATENT DOCUMENTS 4,080,204 3/1978 Panzera ..... 420/40

4,435,212 3/1984 Ueshima et al. ..... 420/583

*Primary Examiner*—Deborah Yee

*Attorney, Agent, or Firm*—Paul E. Rochford; James C. Davis, Jr.; James Magee, Jr.

[57] ABSTRACT

A substantial gain in the properties of conventional FeCrAlY is achieved by adding RuAl to a melt of the conventional material. The resultant composition has a use temperature above the melting point of nickel base superalloys and has good strength and ductility properties to permit its use as a high temperature structural material.

5 Claims, 3 Drawing Sheets

ETCH 10 HCl 7 $H_2O_2$ 260X

ETCH 10 HCl 7 $H_2O_2$ 260X

RUTHENIUM BEARING IRON BASE HIGH TEMPERATURE STRUCTURAL ALLOYS

This application is a continuation of application Ser. No. 07/208,905, filed June 20, 1988, now abandoned.

BACKGROUND OF THE INVENTION

The present invention relates generally to alloys formed for structural use at high temperatures. More particularly, it relates to an iron-base structural alloy having a novel ruthenium content and adapted to use at high temperatures. It is known that jet engines operate more efficiently at higher temperatures than at lower temperatures. Increase in the operating temperature of an engine can give the engine itself higher performance characteristics. One of the great difficulties in achieving higher operating temperatures in jet engines and in other gas turbines is the lack of materials for the building of engines which can tolerate such high temperatures.

Engines are presently built with nickel-base alloys and more particular nickel-based superalloys which display high strength at high temperatures. However, for more advanced engines the temperature of the materials themselves would be above the temperature at which the conventional nickel-base superalloys will be molten.

Again, one of the basic problems of increasing the operating temperature of engines is that of finding materials which have suitable combination of properties for use at the higher temperatures. The temperatures of structural components in the hottest sections of such engines are envisioned to range from about 1250° C. (2300° F.) to temperatures which are reached when stoichiometric ratios of gas and air are burned. As noted above, such temperatures are above the melting point of presently used nickel-base superalloys. Because of the distinct advantages in the operating at such elevated temperatures, efforts have been made to find alloys from which structural components for use at such temperatures can be formed. If such engines can be built, there is a reward of a greater thrust to weight ratio possible as an improvement over present designs.

Numerous metallic systems have been investigated to determine the hottest temperature at which components of higher temperature jet engines can be employed as structural members. It is known that efforts have been expended to develop ceramic systems for use in the hottest components of such engines. The ceramic systems have the advantage of low density thus increasing the thrust to weight ratio, but they suffer from a lack of, or a lower order of, ductility. The metallic systems which have been studied for such applications include metal matrix composites as well as low density intermediate phases and intermetallic compounds. However, none of these compositions have been found to provide the combination of properties which are needed for structural use in the very high temperature engines.

BRIEF STATEMENT OF THE INVENTION

It is accordingly one object of the present invention to provide compositions which have a desirable set of properties for use as structural elements in high temperature environments.

Another object is to provide a metal component which has the capability of operating in the temperature range of 1250° C. or 2300° F. or higher.

Another object is to provide a metal capable of providing structural elements within a jet engine for operation at very elevated temperatures.

Another object is to provide components of a jet engine capable of operating at very high temperatures.

Another object is to provide a composition capable of structural support in an operating environment at or above the melting point of the commonly used nickel-base superalloys.

Other objects will be in part apparent and in part pointed out in the description which follows.

In one of its broader aspects, objects of the invention can be achieved by providing an alloy containing the following ingredients in approximate weight percent:

| Ingredient | Range of Concentrations in Atomic % | |
|---|---|---|
| | From About | To About |
| Iron | Balance | |
| Chromium | 16 | 24 |
| Ruthenium | 4 | 20 |
| Aluminum | 16 | 30 |

A preferred composition of one of the other aspects of the invention has the following ranges of ingredients:

| Ingredient | Range of Concentrations in Atomic % | |
|---|---|---|
| | From about | To about |
| Iron | Balance | |
| Chromium | 15 | 20 |
| Ruthenium | 10 | 16 |
| Aluminum | 20 | 30 |
| Yttrium | 0 | 0.2 |

As used herein the term balance iron indicates that the other ingredients of the composition are predominantly iron. However it will be understood that other ingredients which do not detract from the beneficial properties of the alloy including impurities normally encountered in metal processing may be present as well.

It is believed that an optimum composition of the present invention is within the following compositional range:

| Ingredient | Range of Concentrations in Atomic % | |
|---|---|---|
| | From about | To about |
| Iron | Balance | |
| Chromium | 15 | 20 |
| Ruthenium | 13 | 15 |
| Aluminum | 24 | 30 |
| Yttrium | 0 | 0.2 |

BRIEF DESCRIPTION OF THE DRAWINGS

The invention which is here described will be better understood by a reading of the following specification taken together with the accompanying drawings in which.

DETAILED DESCRIPTION OF THE INVENTION

The present invention concerns structural alloys which have solidification temperatures about 2850° F. and which have use temperatures of 2300° F. and above. One aspect of the invention rests on the discovery that the properties of a known high temperature material FeCrAlY can be strikingly improved by additions of RuAl as ingredients.

EXAMPLES 1–4

Four alloy compositions were prepared to have ingredients and concentrations in atomic percent as illustrated in Table I below.

The alloys of Examples 1, 2, 3, and 4 were prepared by induction melting of four separate melts which were then each cast into ingots.

TABLE I

| Example No. | Fe | Cr | Ru | Al | Y |
|---|---|---|---|---|---|
| 1 | 59.9 | 24 | — | 16 | 0.1 |
| 2 | 53.9 | 21.6 | 5 | 19.4 | 0.1 |
| 3 | 47.9 | 19.2 | 10 | 22.8 | 0.1 |
| 4 | 41.9 | 16.8 | 15 | 26.2 | 0.1 |

It was observed that the castings formed were coarse grained and radially columnar. The radial columnar structure and coarse grain structure of the castings resulted in their having a low ductility even though FeCrAlY alloy of Example 1 is known normally be a ductile composition.

Figure 1:
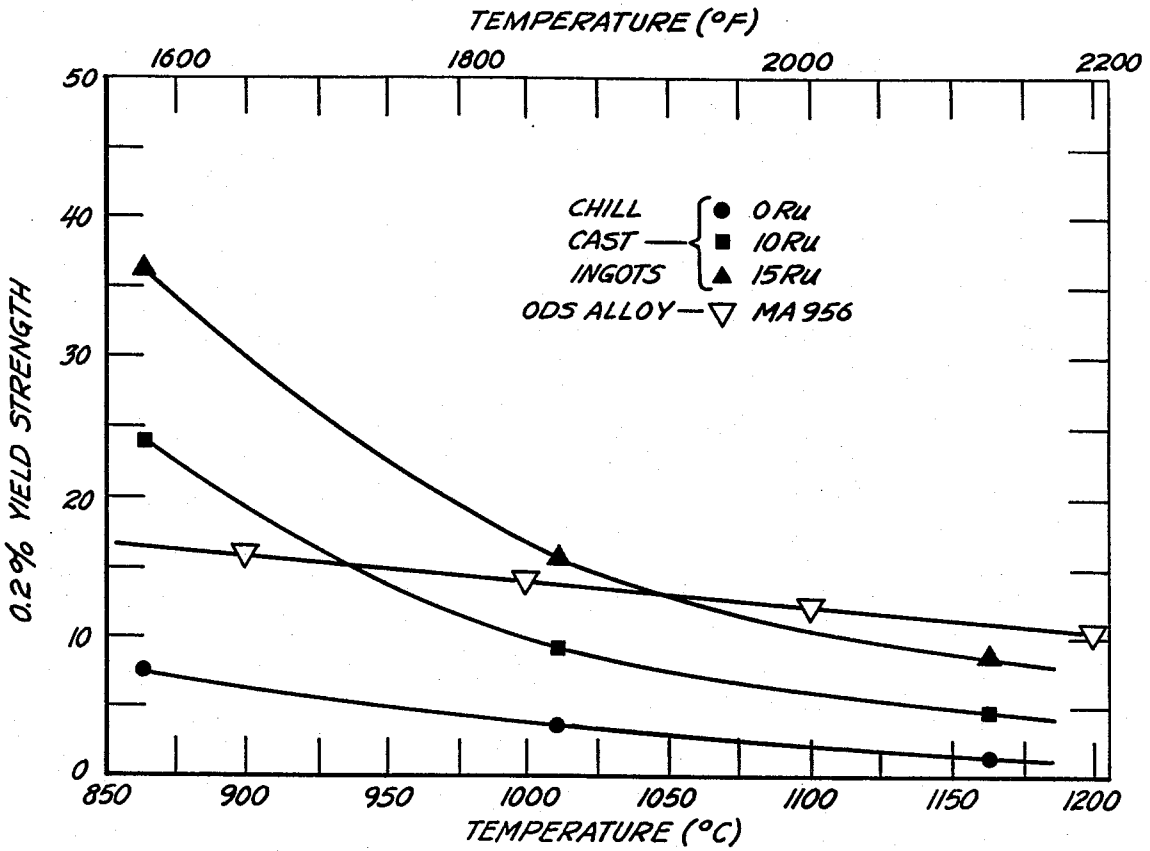
FIG. 1 is a graph in which the yield strength in ksi is plotted against temperature and degrees centigrade and Fahrenheit for a number of compositions which contain various concentrations of ruthenium.

The alloy of Example 2 was machined in order to prepare test specimens of the sample but difficulties in machining the alloy of Example 2 resulted in the sample with 5 atomic percent ruthenium being eliminated from the testing accorded the alloys 1, 3 and 4. The other three alloys could be machined and were machined to provide tensile test specimens. The alloys of Examples 3 and 4 were tensile tested at temperatures from 860° C. to 1160° C. (1580° F. to 2120° F.). The results which were obtained from the tests are plotted in FIG. 1. In this Figure, three different samples of alloy were tested at the temperatures indicated in the abscissa of the graph. The FeCrAlY sample of Example 1 was tested and found to have the lowest yield strength in ksi at the temperatures tested as illustrated in FIG. 1. The sample containing 10 atomic percent ruthenium had a very distinct improvement in tensile strength and, as can be seen from the Figure, was more than twice as strong in this tensile property than the FeCrAlY alloy which contained no ruthenium.

The sample which contained 15 atomic percent ruthenium may also be seen from the graph as having the highest tensile properties over the full temperature range of up to 2150° F. It is clear from these data that the samples containing the 10 and 15 percent of ruthenium provide very distinct improvement in yield strength over the sample which had no ruthenium present. For comparison, a sample of alloy MA956 is included in FIG. 1.

The alloy MA956 is an oxide dispersion strengthened FeCrAlY alloy which has been mechanically alloyed through powdered metallurgy techniques and is supplied commercially by the International Nickel Company.

As may be seen from FIG. 1, the addition of the RuAl to the FeCrAlY base cast ingots resulted in substantial strengthening. The yield strength was approximately tripled by the 10 RulOAl addition and was increased five fold by the 15 Ru15Al addition. The results of the tensile testing of the novel ruthenium-containing alloy were results obtained by conventional testing. The results are tabulated in Table II.

TABLE II

| Example No. | Alloy | Temperature (°C.) | 0.2% Yield Strength (ksi) | Ultimate Strength (ksi) | Uniform Strain (%) | Fracture Strain (%) | Reduction of Area (%) |
|---|---|---|---|---|---|---|---|
| 1 | 0 Ru | 860 | 7.6 | 7.8 | 0.2 | 83.6 | 91.0 |
| | | 1160 | 1.7 | 1.7 | 0.3 | 112.9 | 92.6 |
| 3 | 10 Ru | 860 | 23.3 | 26.0 | 1.2 | 34.7 | 54.8 |
| | | 1010 | 9.7 | 11.0 | 0.8 | 74.1 | 85.2 |
| | | 1160 | 5.0 | 5.1 | 0.8 | 138.0 | 93.9 |
| 4 | 15 Ru | 860 | 36.1 | 40.6 | 1.0 | 5.9 | 11.3 |
| | | 1010 | 15.8 | 18.8 | 1.0 | 14.3 | 15.3 |
| | | 1160 | 8.7 | 9.6 | 0.9 | 28.0 | 29.5 |

From the tabulated data, it is evident that the compositions containing the 10 and 15 atomic percent ruthenium are very strong and accordingly very valuable alloys.

Figure 3A:
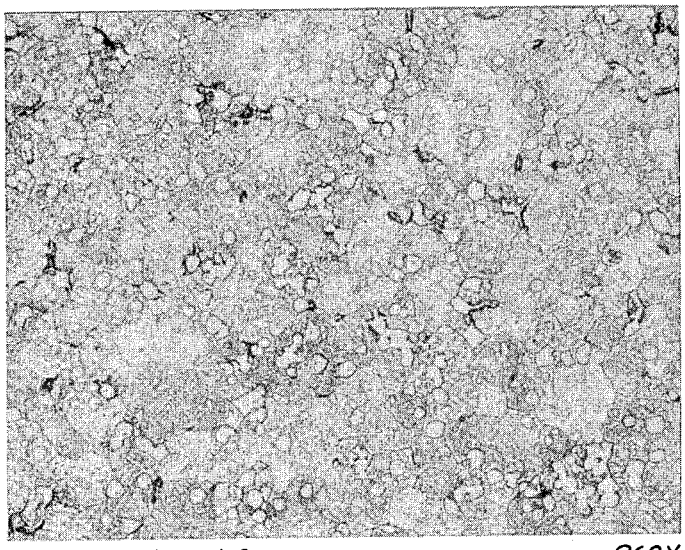
FIGS. 3*a* and 3*b* are photomicrographs in which samples of alloys as provided pursuant to the present invention are shown at high magnification.
Figure 3B:
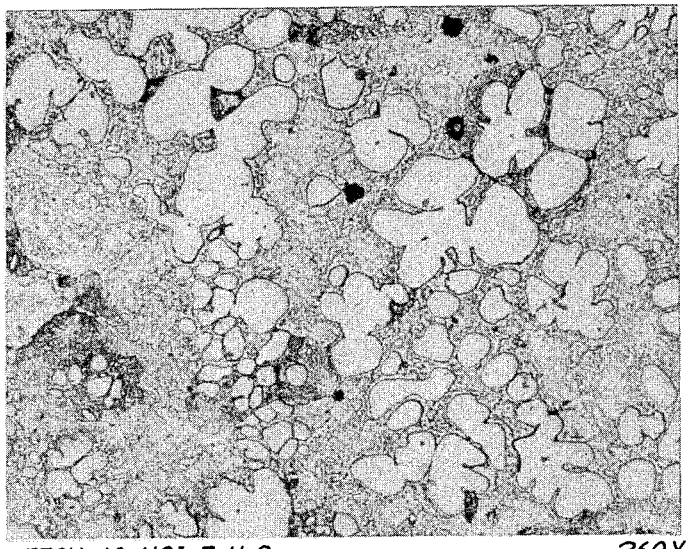

The microstructures of the alloys containing the 10 and 15 atomic percent ruthenium were obtained in a conventional fashion. The photomicrographs of this microstructure are provided in FIG. 3. The upper figure, FIG. 3A, has a magnification of 260× and displays the composition with the 10 atomic percent ruthenium. The lower portion of the figure, FIG. 3B, is at the same magnification and displays the microstructure of the sample containing 15 atomic percent ruthenium.

A large second phase is evident in the Figures and it was determined by analysis to be B-2 (body centered) structure (Ru,Fe)Al, normally identified as $\beta$. The size and morphology of the second phase suggests that it is possible to achieve greater strength and ductility by refining the second phase grain size.

The FeCrAlYRu material may be directionally solidified, or potentially may be oxide dispersion strengthened (ODS treated) in a manner similar to the ODS MA956.

Solidification temperatures for these materials are approximately 1570° C. (2860° F.) as compared to less than 1350° C. (2460° F.) for typical nickel-base superalloys.

Figure 2:
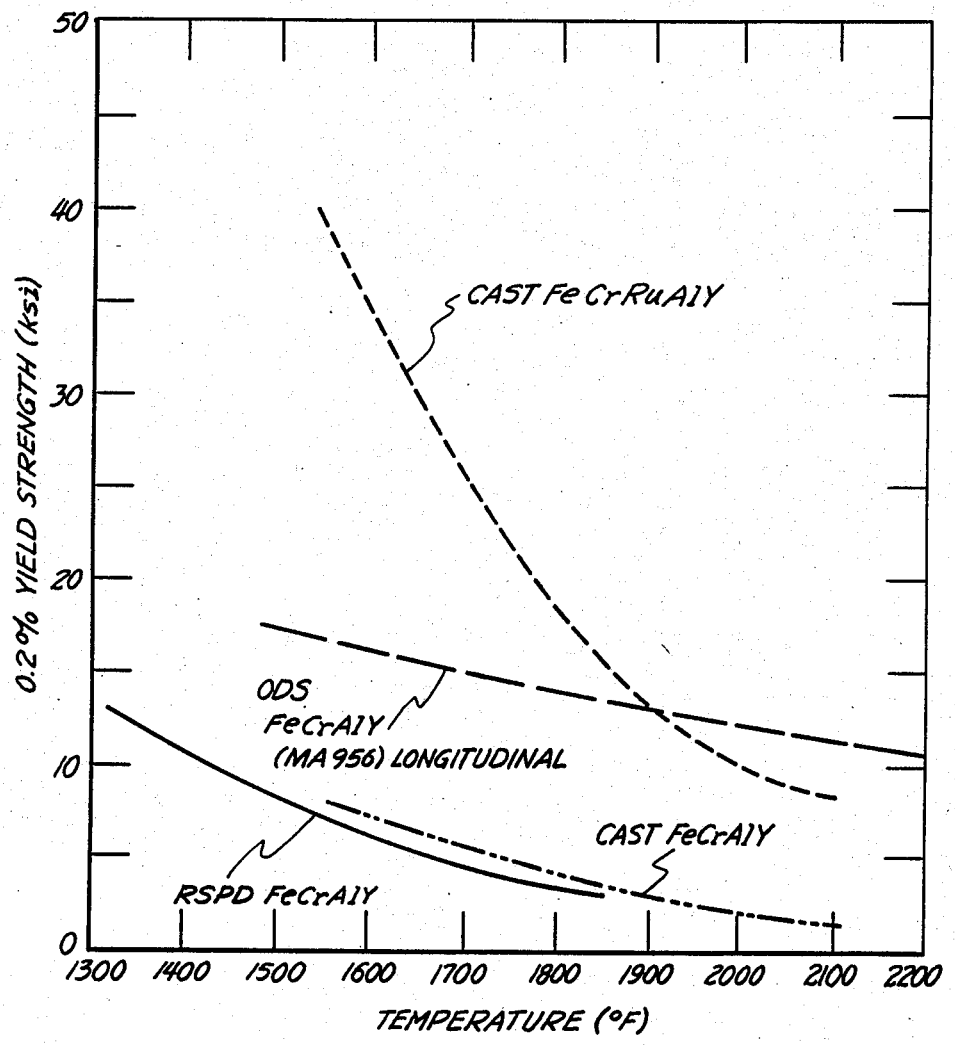
FIG. 2 is a graph in which yield strength in ksi is plotted against temperature for a number of compositions prepared by different methods and showing a contrast between the alloys which do not contain ruthenium and those that do.

The strength of the novel FeCrRuAlY alloy of this invention is shown in relation to materials prepared by casting and rapid solidification deposition in FIG. 2. It is evident from this figure that incorporation of the ruthenium aluminum in the FeCrAlY alloy results in a very significant increase in the tensile strength of the alloy. In general cast alloy tends to be coarse grained and rapidly solidified plasma deposited (RSPD) alloy tends to be fine grained. This difference in grain structure accounts for a small part of the differences in properties of materials prepared by the two different methods.

It will be realized that an alloy for use at very high temperatures may be subject to oxidation. The incorporation of additional aluminum in the alloy has been found to be of substantial assistance in achieving an alloy which can be protected from oxidative degradation.

Accordingly, it is apparent from the foregoing that a novel and unique high temperature structural alloy is provided pursuant to the present invention. Further it is apparent that this novel alloy has a very desirable set of properties including strength and ductility properties.

What is claimed is:

1. As a composition of matter an alloy containing the following ranges of concentration of ingredients:

| Ingredient | Range of Concentrations in Atomic % | |
|---|---|---|
| | From about | To about |
| Iron | Balance | |
| Chromium | 15 | 20 |
| Ruthenium | 4 | 20 |
| Aluminum | 16 | 30 |

2. The composition of claim 1 in which the ingredient ranges as follows:

| Ingredient | Range of Concentrations in Atomic % | |
|---|---|---|
| | From About | To About |
| Iron | Balance | |
| Chromium | 15 | 20 |
| Ruthenium | 10 | 16 |

-continued

| Ingredient | Range of Concentrations in Atomic % | |
|---|---|---|
| | From About | To About |
| Aluminum | 20 | 30 |
| Yttrium | 0 | 0.2 |

3. The composition of claim 1 in which the ingredient ranges as follows:

| Ingredient | Range of Concentrations in Atomic % | |
|---|---|---|
| | From About | To About |
| Iron | Balance | |
| Chromium | 15 | 20 |
| Ruthenium | 13 | 15 |
| Aluminum | 24 | 30 |
| Yttrium | 0 | 0.2 |

4. A structural element said element having formed of a composition having the following ingredient concentration ranges:

| Ingredient | Range of Concentrations in Atomic % | |
|---|---|---|
| | From about | To About |
| Iron | Balance | |
| Chromium | 15 | 20 |
| Ruthenium | 4 | 20 |
| Aluminum | 16 | 30 |

5. A structural about said element being formed of a composition having the following ingredient concentration ranges:

| Ingredient | Range of Concentrations in Atomic % | |
|---|---|---|
| | From about | To About |
| Iron | Balance | |
| Chromium | 15 | 20 |
| Ruthenium | 10 | 16 |
| Aluminum | 20 | 30 |
| Yttrium | 0 | 0.2 |

* * * * *